US012024995B2

(12) United States Patent
Marck et al.

(10) Patent No.: US 12,024,995 B2
(45) Date of Patent: Jul. 2, 2024

(54) PERTURBATION BASED WELL PATH RECONSTRUCTION

(71) Applicant: HALLIBURTON ENERGY SERVICES, INC., Houston, TX (US)

(72) Inventors: Julien Marck, Houston, TX (US); Robert P. Darbe, Tomball, TX (US); Umut Zalluhoglu, Humble, TX (US); Nazli Demirer, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 176 days.

(21) Appl. No.: 17/422,410

(22) PCT Filed: Feb. 19, 2019

(86) PCT No.: PCT/US2019/018526
§ 371 (c)(1),
(2) Date: Jul. 12, 2021

(87) PCT Pub. No.: WO2020/171799
PCT Pub. Date: Aug. 27, 2020

(65) Prior Publication Data

US 2022/0120170 A1 Apr. 21, 2022

(51) Int. Cl.

| | |
|---|---|
| ***E21B 7/04*** | (2006.01) |
| ***E21B 47/022*** | (2012.01) |
| ***E21B 47/12*** | (2012.01) |
| ***E21B 47/26*** | (2012.01) |

(52) U.S. Cl.
CPC ..... *E21B 47/022* (2013.01); *E21B 7/04* (2013.01); *E21B 47/12* (2013.01); *E21B 47/26* (2020.05)

(58) Field of Classification Search
CPC ... E21B 7/04; E21B 7/10; E21B 47/02; E21B 47/12; E21B 47/26; E21B 44/00
See application file for complete search history.

(56) References Cited

U.S. PATENT DOCUMENTS

| | | | |
|---|---|---|---|
| 2003/0024738 | A1 | 2/2003 | Schuh |
| 2010/0185395 | A1 | 7/2010 | Pirovolou et al. |
| 2012/0024606 | A1 | 2/2012 | Pirovolou et al. |

(Continued)

FOREIGN PATENT DOCUMENTS

| | | | |
|---|---|---|---|
| WO | 2018144170 | A1 | 8/2018 |

OTHER PUBLICATIONS

International Search Report and Written Opinion, PCT Application No. PCT/US2019/018526, Mailed on Nov. 18, 2019.

*Primary Examiner* — Robert E Fuller
*Assistant Examiner* — Lamia Quaim
(74) *Attorney, Agent, or Firm* — NOVAK DRUCE CARROLL LLP

(57) ABSTRACT

A well path for a directional drilling device may be updated by determining a perturbation for a new well path from a current bottom-hole assembly position to a target using the initial well plan (or any well path of reference) as a reference. An initial well plan may be determined for a directional drilling device along with a current actual borehole position of a drilling device along with other parameters such as attitude. With this, a perturbation to the well plan based on the current actual borehole position of a drilling device and a subterranean target maybe determined. Based on this perturbation an updated borehole path may be determined.

22 Claims, 4 Drawing Sheets

(56) References Cited

U.S. PATENT DOCUMENTS

| | | | | |
|---|---|---|---|---|
| 2013/0032407 | A1* | 2/2013 | Edbury | E21B 44/06 175/61 |
| 2015/0330209 | A1 | 11/2015 | Panchal et al. | |
| 2016/0186551 | A1* | 6/2016 | Dykstra | E21B 44/00 175/24 |
| 2020/0080380 | A1* | 3/2020 | Gorrara | E21B 7/04 |
| 2020/0109618 | A1* | 4/2020 | Flanagan | E21B 7/10 |

* cited by examiner

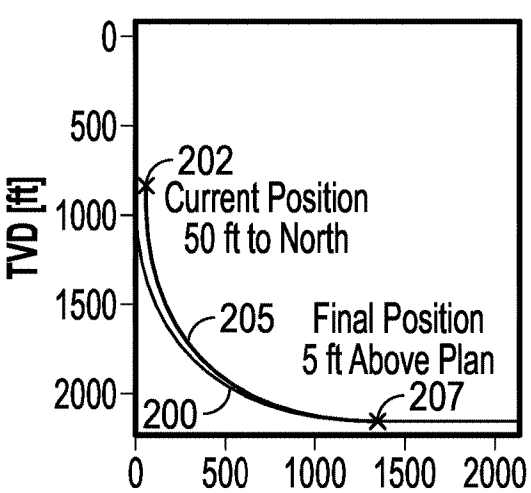
FIG. 2A
FIG. 2B
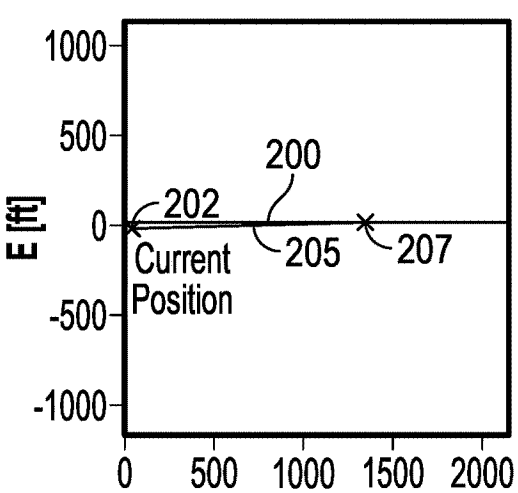
FIG. 2C
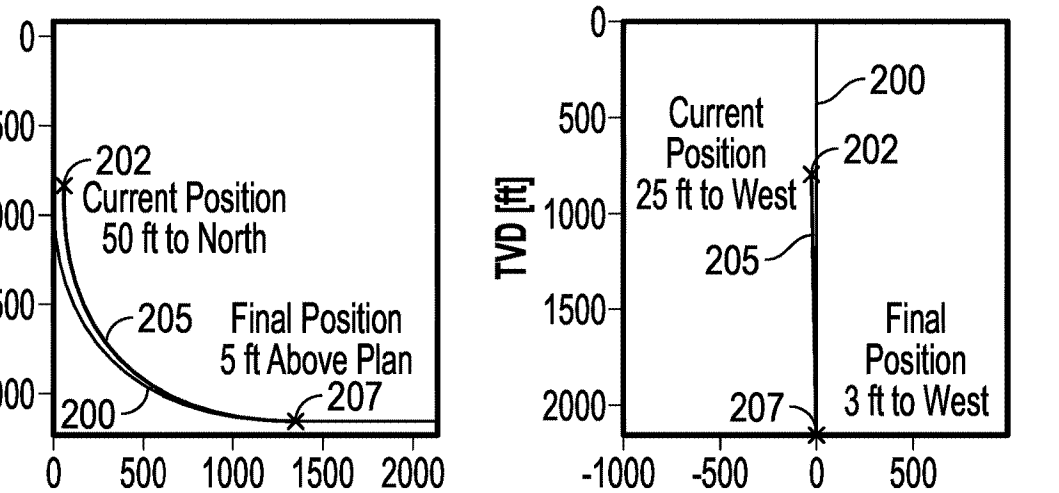
FIG. 2D
FIG. 2E

PERTURBATION BASED WELL PATH RECONSTRUCTION

CROSS-REFERENCE TO RELATED APPLICATIONS

This application is a national stage entry of PCT/US2019/018526 filed Feb. 19, 2019. Said application is expressly incorporated herein by reference in its entirety.

FIELD

The present disclosure relates to downhole directional drilling, and in particular, determining a borehole path for a directional drilling device.

BACKGROUND

In order to access underground hydrocarbon reservoirs, boreholes must be drilled deep within the earth's surface. In modern drilling these boreholes are often deviated and non-vertical. Accordingly, directional drilling is required to reach intended destinations and form the borehole along a desired predetermined pathway. The course and trajectory of a borehole path are planned in advance in the form of a well plan. During drilling, operators must be able to determine whether their drills are drilling properly along the well plan as well as apply proper controls for making any corrections. Various steerable devices may be used for directional drilling including bent subs, as well as rotary steerable drilling devices. Software and hardware are developed to assist in proper controls of the directional drilling devices during drilling by operators on the surface.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not, therefore, to be considered to be limiting of its scope, the principles herein are described and explained with additional specificity and detail through the use of the accompanying drawings in which:

FIG. 2A is a graph illustrating total vertical depth (TVD) versus "North" for an updated well path for a directional drilling device;

FIG. 2B is a graph illustrating TVD versus "East" for an updated well path for a directional drilling device;

FIG. 2C is a graph illustrating "East" versus "North" for an updated well path for a directional drilling device;

FIG. 2D illustrates the curvilinear offset of the wellbore path from the well path of reference as a function of measured depth ("MD");

FIG. 2E illustrates the relative Dog Leg Severity ("DLS") of the wellbore path from the well path of reference as a function of MD;

DETAILED DESCRIPTION

Figure 1:
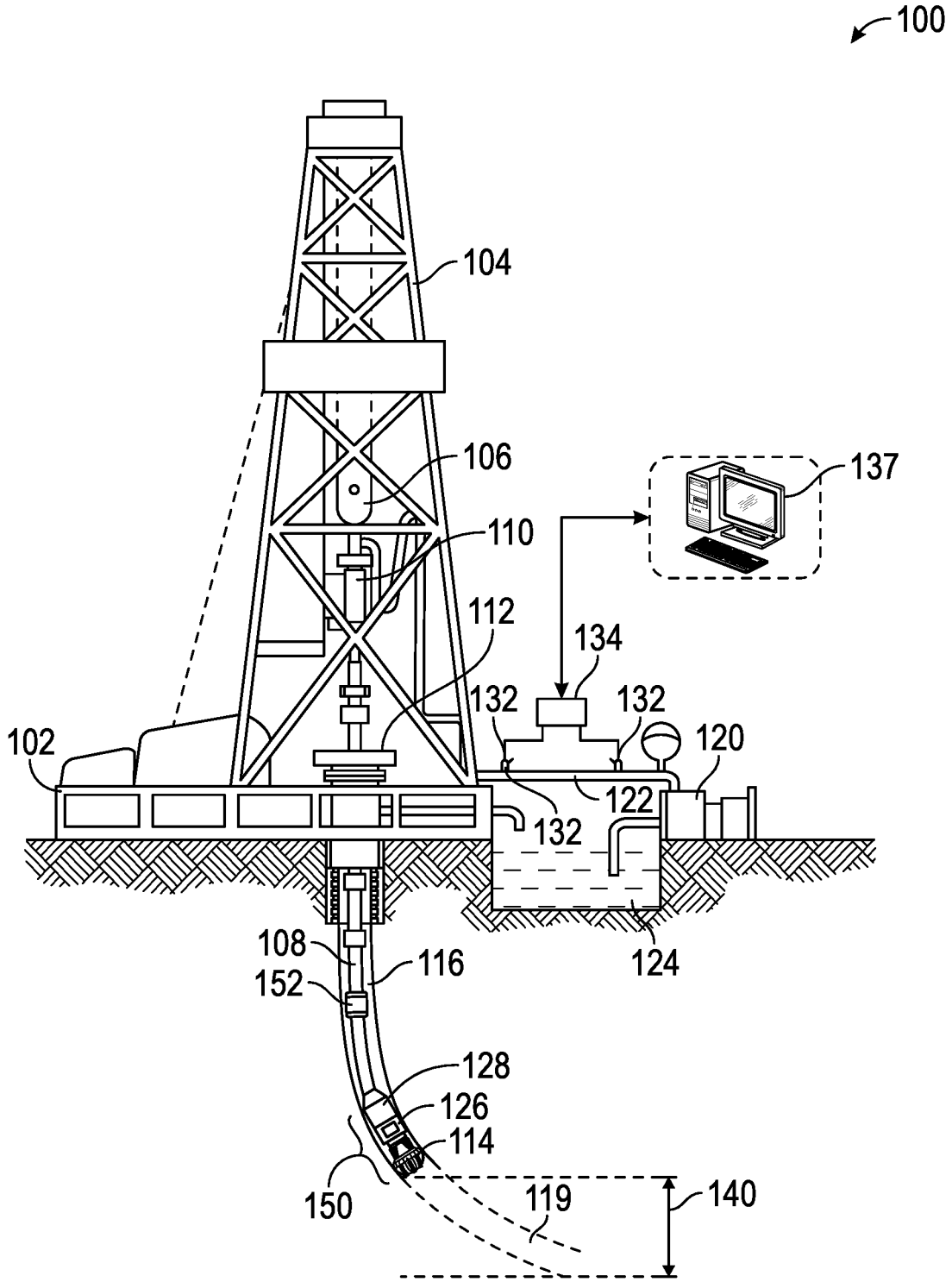
FIG. 1 is a schematic diagram of a directional drilling environment.

Various embodiments of the disclosure are discussed in details below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Disclosed herein is a system and method for an updated wellbore path by determining a perturbation (i.e., offset) around a well path of reference. When drilling a wellbore, an initial well path of reference is devised, which may be, for instance, an initial well plan. This well path of reference is the desired path for the drilling device and the borehole to be formed. This well path of reference may have a particular final destination, such as a hydrocarbon reservoir, and a particular desirable path to reach that reservoir. During drilling, the drilling device may be shifted off course unintentionally from the well path of reference. This may occur for a variety of reasons, including difficulty in controls or communication with the drilling device, difficulty in position determination, rock properties, or unforeseen obstructions. In order to return to or near the well path of reference, the current drilling path can be updated as disclosed herein.

Disclosed herein is a computationally efficient way for determining an optimized wellbore path for a drilling device to reach a prescribed target associated with the well path of reference (including position, attitude, and curvature) while limiting the borehole tortuosity (and maximizing rate of penetration (ROP) in some applications). The optimized trajectory may be obtained by minimizing a cost function based on a perturbation around the well path of reference.

In determining the perturbation (which may be thought of as the offset from the well path of reference), the final target may be chosen along or near the well path of reference. The target can either be a point in space, a surface, or a volume to reach and/or stay within. As the solution of the problem is formulated as perturbation around the initial well path, this may be considered an Eulerian approach. Additional considerations may include tool-specific constraints (e.g., maximum curvature capabilities or depth/time-constant in the response of the system). This may be implemented to provide guidance for geo-steering applications as well as feasibility conditions as the target(s) are changed or moved. The updated well path (i.e., path of the borehole which forms the well) may have additional constraints and optimized features, such as limited tortuosity, reduced arc length, or allowances on target position to maximized ROP (e.g., by allowing for a lower steer/rotate ratio). The disclosed method may be implemented as a feedback control loop and substantially in real-time or near real-time.

The present disclosed method has the advantage of not requiring a recalculation of the entire well path of reference, but instead, merely an update of the current well path to a target(s) via the perturbation around a path of reference (which may be the initial well plan for instance). The updated well path disclosed herein may provide for a high-quality wellbore with less unintentional deviation and better accuracy in wellbore placement.

FIG. 1 is a schematic diagram of a directional drilling environment, particularly showing a wellbore drilling system 100 having components for measurement-while-drilling (MWD) and logging-while-drilling (LWD) in which the presently disclosed techniques may be deployed. As depicted, the system 100 includes a drilling platform 102 having a derrick 104 and a hoist 106 to raise and lower a drill string 108. Hoist 106 suspends a top drive 110 suitable for rotating drill string 108 and lowering drill string 108 through a well head 112. Notably, drill string 108 may include sensors or other instrumentation for detecting and logging nearby characteristics and conditions of the wellbore and the surrounding earth formation.

In operation, top drive 110 supports and rotates drill string 108 as it is lowered through well head 112. In this fashion, drill string 108 (and/or a downhole motor) rotate a drill bit 114 coupled with a lower end of drill string 108 to create a borehole 116 through various subterranean formations. A pump 120 can circulate drilling fluid through a supply pipe 122 to top drive 110, down through an interior of drill string 108, through orifices in drill bit 114, back to the surface via an annulus around drill string 108, and into a retention pit 124. The drilling fluid can transport cuttings from borehole 116 into pit 124 and helps maintain wellbore integrity. Various materials can be used for drilling fluid, including oil-based fluids and water-based fluids.

As shown, drill bit 114 forms part of a directional drilling device 150. The directional drilling device 150 may be any drilling device which can be used to deviate a borehole in a controllable fashion. The directional drilling device 150 includes a bottom-hole assembly having a steering system further described below. Detection tools 126 and a telemetry sub 128 are coupled to or integrated with one or more drilling collars.

Detection tools 126 may gather MWD and LWD data or other data and may include various types of electronic sensors, transmitters, receivers, hardware, software, and/or additional interface circuitry for generating, transmitting, and detecting signals (e.g., sonic waves, etc.), storing information (e.g., log data), communicating with additional equipment (e.g., surface equipment, processors, memory, clocks input/output circuitry, etc.), and the like. In particular, detection tools 126 can measure data such as position, orientation, weight-on-bit, strains, movements, borehole diameter, resistivity, drilling tool orientation, which may be specified in terms of a tool face angle (rotational orientation), and inclination angle (the slope), and compass direction, each of which can be derived from measurements by sensors (e.g., magnetometers, inclinometers, and/or accelerometers, though other sensor types such as gyroscopes, etc.).

Telemetry sub 128 communicates with detection tools 126 and transmits telemetry data to surface equipment (e.g., via mud pulse telemetry). For example, telemetry sub 128 can include a transmitter to modulate resistance of drilling fluid flow thereby generating pressure pulses that propagate along the fluid stream at the speed of sound to the surface. One or more pressure transducers 132 operatively convert the pressure pulses into electrical signal(s) for a signal digitizer 134. It is appreciated other forms of telemetry such as acoustic, electromagnetic, telemetry via wired drill pipe, and the like may also be used to communicate signals between downhole drilling tools and signal digitizer 134. Further, it is appreciated that the telemetry sub 128 can store detected and logged data for later retrieval at the surface when the directional drilling device 150 is recovered.

Digitizer 134 converts the pressure pulses into a digital signal and sends the digital signal over a communication link to a computing system 137 or some other form of a data processing device. In at least some embodiments, computer system 137 includes processing units to analyze collected data and/or perform other operations by executing software or instructions obtained from a local or remote non-transitory computer-readable medium. As shown, computer system 137 includes input device(s) (e.g., a keyboard, mouse, touchpad, etc.) as well as output device(s) (e.g., monitors, printers, etc.). These input/output devices provide a user interface that enables an operator to interact and communicate with the directional drilling device 150, surface/downhole directional drilling components, and/or software executed by computer system 137.

For example, computer system 137 enables an operator to select or program directional drilling options, review or adjust types of data collected, modify values derived from the collected data (e.g., measured bit position, estimated bit position, bit force, bit force disturbance, rock mechanics, etc.), adjust borehole assembly dynamics model parameters, generate drilling status charts, waypoints, a desired borehole path, an estimated borehole path, and/or to perform other tasks. In at least some embodiments, the directional drilling performed by directional drilling device 150 is based on a surface and/or downhole feedback loops, as discussed in greater detail below.

System 100 also includes a controller 152 that instructs or steers directional drilling device 150 as drill bit 114 extends borehole 116 along a desired path 119 (e.g., within one or more boundaries 140). The directional drilling device 150 includes a steering system, such as steering vanes, bent stub, or rotary steerable system (RSS), thereby together with the drill bit 114 form a directional drilling tool and may be part of the bottom-hole assembly. Accordingly, the directional drilling device may be an RSS, and in particular a point-the-bit or push-the-bit RSS system, or alternatively may have a mud motor which rotates the drill bit 114 as mud, for example from pit 124, is circulated through the drill string 108. Controller 152 may include processors, sensors, and other hardware/software and which may communicate to components of the steering system. For instance, with some kind of RSS, such as point-the-bit systems, the controller 152 sends a command(s) to the tool to flex or bend a drilling shaft coupled to directional drilling device 150, thereby imparting an angular deviation to the direction of the drill bit 114. Controller 152 can communicate in real time data with one or more components of directional drilling device 150 and/or surface equipment. In this fashion, controller 152 can analyze real-time data and generate steering signals according to, for example, the feedback control techniques discussed herein. While controller 152 is shown and described as a single component that operates for a particular type of directional drilling, it is appreciated controller 152 may include any number of sub-components that collectively communicate and operate to perform the above-discussed functions. The controller 152 may be located downhole as illustrated or at the surface. Controller 152 represents an example component, which may further include various other types of steering mechanisms as well—e.g., steering vanes, a bent sub (and where the drill string includes a mud motor), and the like. It is further appreciated by those skilled in the art, the environment shown in FIG. 1 is provided for purposes of discussion only, not for purposes of limitation. The detection tools, drilling devices, and sliding mode control techniques discussed herein may be suitable in any number of drilling environments.

The present disclosure provides a method for determining a perturbation for updating a new well path from a current bottom-hole assembly position to a subterranean target using a well path of reference, which may be and initial well plan. For instance, given a current well path, which may be represented by Cartesian coordinates (X(MD), Y(MD), Z(MD), where MD is the measured depth along the borehole, at least one predetermined target, and the current bottom-hole position, an updated well path can be determined. The target may also include a parameter involving attitude, along with some leniency tolerance (i.e., boundary parameters), for the target position, attitude, and/or curvature. The attitude may be the current attitude of one or more of a bottom hole assembly (or any sensor along the bottom hole assembly, drill bit, or borehole. The updated path (or path trajectory) may be optimized through a cost function that may include arc length, offset respective to the path of reference (such as the original well plan) or other some subterranean targets, relative inclination, relative curvature, change of curvature, or any component that aims at improving borehole quality and drilling efficiency.

The perturbation determination may include breaking down the path updating problem into a series of simpler problems for solution, for instance converting the positions and path into two 2-dimension problem. This resolution into a set of simpler solved solutions allows for decreased processing and computation requirements. In this model, classic Euclidian distance between a point and a curve are considered. This distance is then projected in two planes to compute the "Easting" and "Northing" offsets: the vertical plane including the tangent to the well path of reference and the plane perpendicular to it, and also including the tangent. The computation of a perturbation around a path or reference allows for a global linearization of the formulation.

FIGS. 2A to 2E, each considered in turn below, are graphs illustrating an output of a method for updating a well path with respect to a curve-lateral well constrained to a vertical plan. In particular, FIGS. 2A to 2C show the current borehole position in terms of East and North (i.e., "Easting" and "Northing" offsets). While East and North are illustrated herein, any two of the four cardinal directions may be employed, such as West and South as well. In the embodiment shown in FIGS. 2A to 2C, line 200 is the well path of reference, whereas line 205 is the obtained updated well path. The updated well path line 205 shows the updated reconstructed well path using a high-order polynomial, both in the Eulerian workspace and the Cartesian workspace.

The current borehole position 202 is shown as 50 ft. to the North and 25 ft. to the West of the initial well path of reference, whereas the target 207 has a tolerance parameter of 5 ft. in TVD and 3 ft. in Easting. The inclination of the borehole at the target has a tolerance parameter of 1 degree, but no tolerance is permitted in azimuth. The continuity of the curvature may also be imposed at the target. These aforementioned parameters may be determined prior to or during drilling, and may be provided based on the requirements of the project, equipment, or properties of the rock, such as hardness, dip, and anisotropy. These values are provided only as examples in FIGS. 2A to 2C, and it will be understood that values may differ for each drilling project.

As shown in FIG. 2A, the vertical axis is the total vertical depth ("TVD") in ft. and the horizontal axis is "North" in ft. This graph shows the current position 202 of the bottom-hole assembly is 50 ft. north of the well path of reference line 200 (which may be an initial well plan), along with updated well path line 205. The target 207 is on the path of reference line 200. The target 207 has a tolerance parameter of 5 ft (i.e., a tolerance of 5 ft in "TVD").

In FIG. 2B, the vertical axis is again TVD, but the horizontal axis is "East" in ft. This graph shows the current position 202 of the bottom-hole assembly is 25 ft. west of the path of reference. The target 207 has a tolerance parameter of 3 ft. (i.e., a tolerance of 3 ft in "Easting"). FIG. 2C illustrates a graph having a well path of reference line 200, an updated well path line 205, and a target 207 in terms of both East and North, with the East shown in the vertical axis, and North shown in the horizontal axis.

The graphs shown in FIGS. 2D and 2E illustrate relative perturbations (offsets) to the well path of reference and the relative curvatures, respectively. In particular, FIG. 2D illustrates the offset as a function of MD, with the top portion of the graph (above the well path of reference 200) illustrating the perturbation from the well path of reference 200 in the vertical plane, both in position and in inclination (depicted as $\Delta\Theta$). Here, the reconstructed perturbation indicated by line 240 goes to the target 207, and illustrates the perturbation with no leniency given on the target position and inclination. Tolerance parameters provide some leniency in reaching target 207, which is indicated by reconstructed perturbation line 245 which goes to a tolerance target 250, which is offset a distance from the actual target 207. Similarly, the lower portion of the graph (below the well path of reference 200) illustrates the perturbation (offset) from the well path of reference 200 in the pseudo-azimuth plane. Here, the reconstructed perturbation indicated by line 240 goes to the target 207 when no leniency is allowed on target position and azimuth. The boundary parameters provide some leniency in reaching target 207, and so reconstructed perturbation 245 goes to a tolerance target 260, which is offset a distance from the actual desired target 207. In FIG. 2D the reconstructed perturbation lines 240 are solutions obtained by fitting high-order polynomials between the current position 202 and the tolerance targets 250, 260. The final position of the target, defined by 250, 260, is an actual solution of the optimization problem. The actual position and attitude at the target is an output of the problem. FIG. 2E illustrates the relative Dog Leg Severity ("DLS") as a function of MD, in terms of the perturbations in the inclination and the pseudo-azimuth planes. Here, the continuity of the perturbed curvature is imposed by the use of polynomials, however, the interpolation functions used to reconstruct the perturbation can take different mathematical shapes (e.g. trigonometric or polynomial-by-part functions).

Accordingly, the updated path can be computed as in FIGS. 2A-2E by dividing the problem into two simplified 2-dimensional problems ("East" and "North"). The simplification permits computation of the solution with much less processing power requirements.

Figure 3:
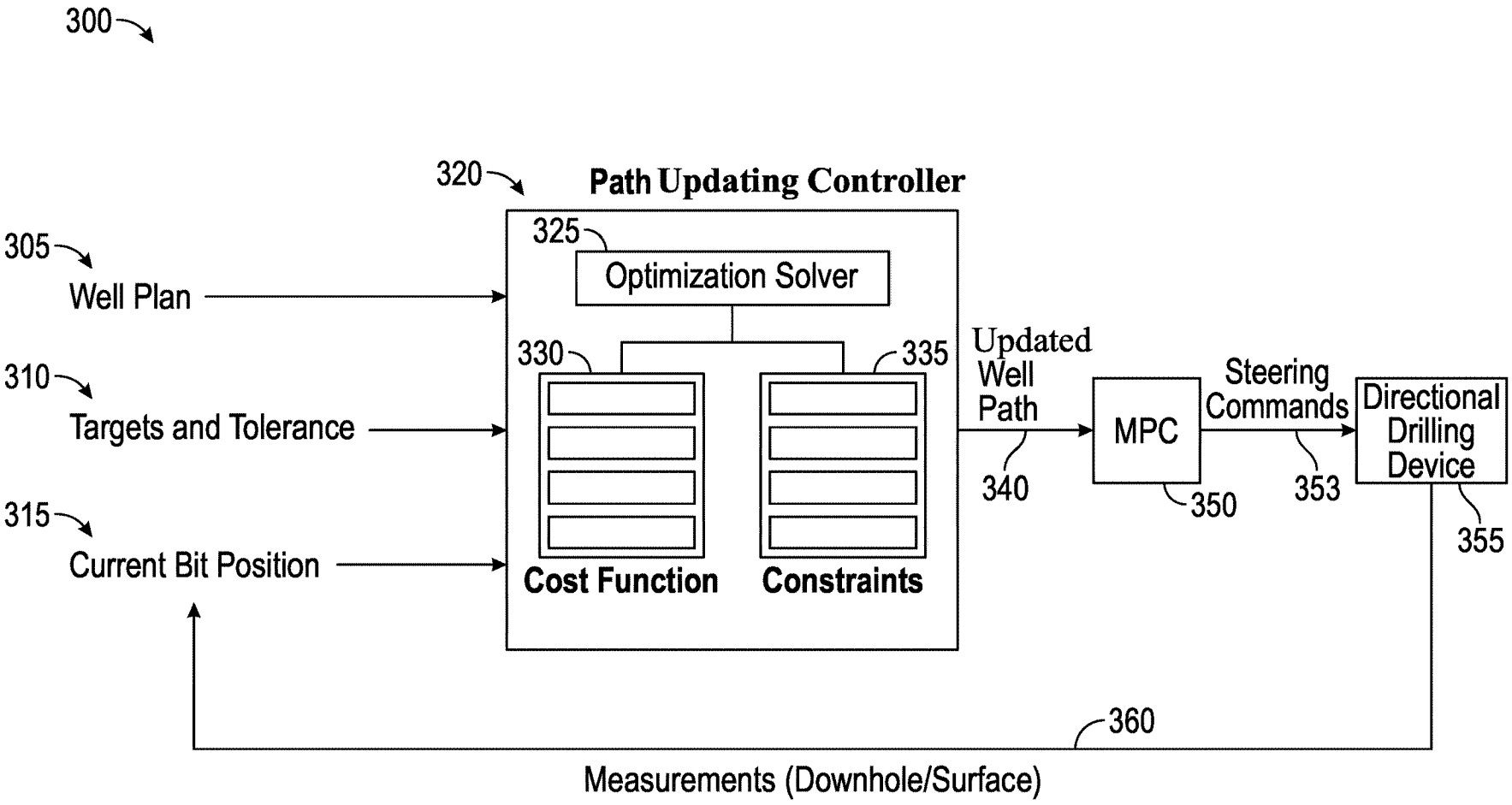
FIG. 3 is a block diagram of the path updating method disclosed herein.
Figure 4:
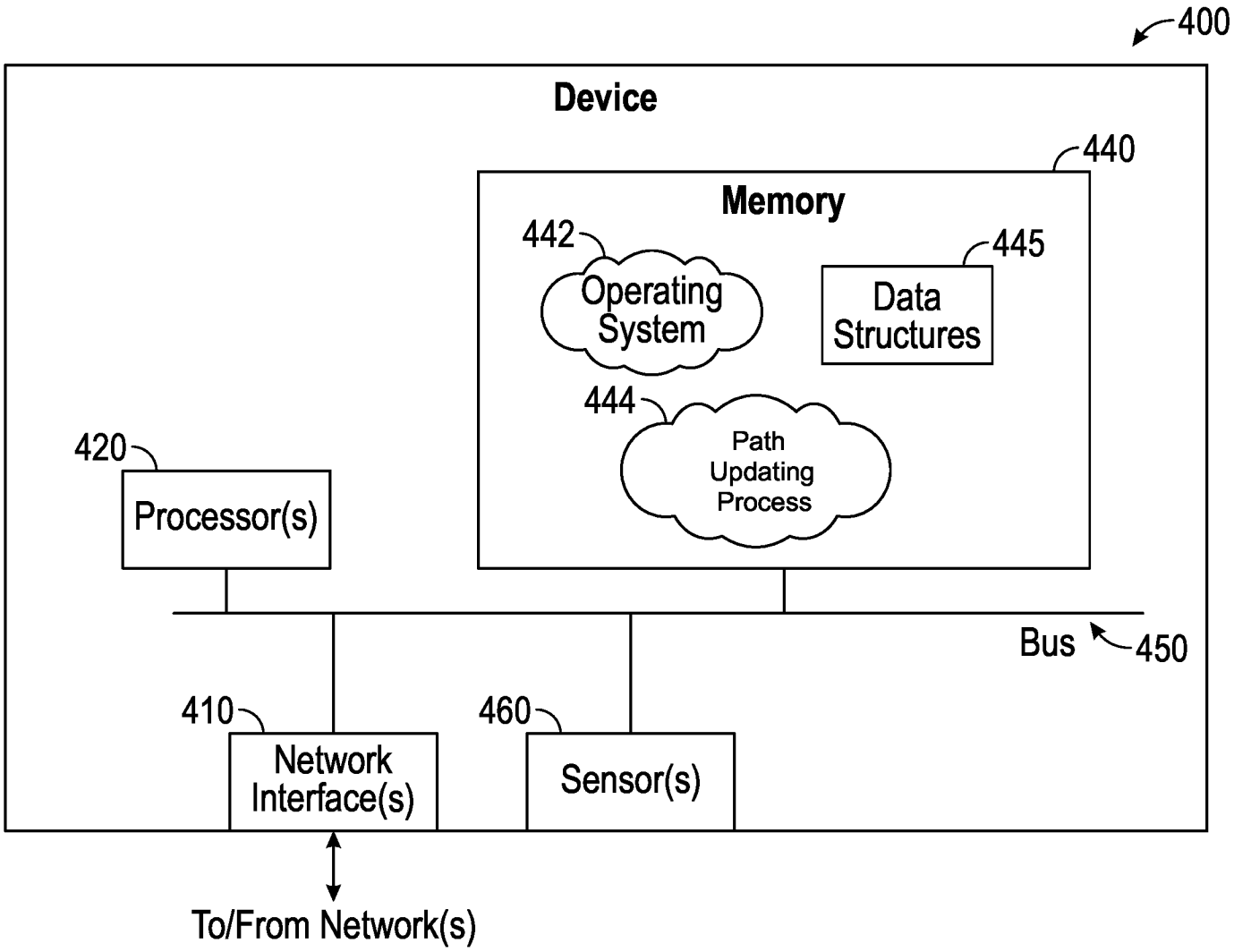
FIG. 4 is a schematic diagram of a control device for a directional drilling tool.

FIG. 3 is a block diagram illustrating one embodiment of a well path updating control system 300, which is employed for steering a drilling tool along a wellbore path. Well path updating control system 300 may be implemented within or as part of controller 152 (see FIG. 1) and/or device 400 (FIG. 4 below). As an initial input into system 300, a well path of reference 305 (which may be an initial well plan) is provided into the path updating controller 320. The well path of reference 305 may include an intended path for a directional drilling device as well as a final destination, such as directional drilling device 150. The well path of reference 305 may provide the route to be taken from the surface to an end location, such as a desired reservoir, with the path taking into account potential obstructions, rock types, environmentally protected zones (such as water), or to maximize eventual hydrocarbon production.

Additionally, provided into the path updating controller 320 is the current drill bit position 315, which may be used to indicate the directional drilling device's current borehole position. Along with this, the targets and tolerances 310 are provided. There may be one or a plurality of subterranean targets for the updated well path. Of a plurality of targets, some may be "hard," as in they must be achieved, and those that are "soft" in that they may be achieved is feasible, or following within various tolerances described herein. The targets may be on the path of the well path of reference or may be positioned a distance from the well path of reference. The tolerance may include boundary parameters with regard to position or attitude. For instance, the position tolerance may include a distance of from 1 to 30 ft. from the desired target, or other distance. The tolerance may depend on the degree of control or the accuracy in the ability to identify the actual position or attitude of the targeted subterranean formation, for example, and which may depend on the shape and thickness of the reservoirs. Targets may be updated during the drilling process as more information is collected on the relative positions of the rock formations. Moreover, there may be no-go zones or areas where the updated well path may not go, for example areas to avoid for anti-collision.

The well path of reference 305, targets and tolerance 310, and the current drill bit position 315 may be provided into the path updating controller 320. The path updating controller 320 computes a perturbation, namely, the offset of the current drill bit position from the well path of reference 305. The path updating controller 320 obtains an updated (or reconstructed) well path 340 based on the perturbation for a drilling device to move in a curvilinear path from the current drill bit position 315 to the target (along with tolerances). The target, for example, the target may be at or near the initially provided well path of reference 305. The path updating controller 320 may compute the updated well path 340 with reference to constraints 335. The constraints 335 may be physical limitations or other limitations which constrain the path of the updated well path 340, such as the maximum offset from the well path of reference, a maximum curvature along the well path, or a physical constraint of the drilling device, such as the maximum curvature the device can maintain, or the time for steering adjustments. Furthermore, path updating controller 320 also takes into account a cost function 330. The cost function 330 accounts for the relative cost (e.g., the amount) of one or more factors in computing the updated well path 340. In particular, a gain (a weighting function) is provided that measures relative weights of components (i.e., factors) of the cost function. The cost function may consider one or more of a curvilinear length of the wellbore, offset of the wellbore with respect to the well path of reference, inclination of the borehole with respect to the well path of reference, curvature of a current well path, and change of curvature of the well path. By minimizing this cost function, a more suitable perturbation and updated well path may be computed.

The path updating controller 320 may also include an optimization solver 325, which may take into account the cost function 330 and constraints 335. The optimization solver 325 can optimize the reconstructed perturbation, including for instance tortuosity limit, reduced arc length, and/or allowances on target position to maximized ROP (e.g., by allowing for a lower steer/rotate ratio). Furthermore, the feasibility of the reconstructed perturbation can be assessed within specified bounds. If the reconstructed perturbation is determined to be feasible, then the updated well path 340 may be computed based on that reconstructed perturbation.

As further illustrated in FIG. 3, the computed updated well path 340 may be provided to or involve a Model Predictive Control (MPC) controller 350 operable to perform one or more MPC schemes to produce control inputs to steer the drill bit of the drilling device along the updated well path 340. The MPC can be based on one or more models, including a depth domain model of a projected trajectory of the borehole. A depth domain model is a model that is expressed as a function of depth, such as the depth of the drilling tool, the depth of the drill bit, the depth of the bottom hole assembly, or the depth of another component used to form the borehole. In some embodiments, the depth domain model projects the position of the borehole, the azimuth of the borehole, the inclination of the borehole, the tortuosity of the borehole, the rate of change in the curvature of the borehole, as well as other quantifiable metrics of the projected trajectory of the borehole. The MPC controller 350 may utilize the depth domain model to predict the unmeasured borehole and produce control inputs to steer the drill bit of the drilling device along a well path, such as the updated well path 340.

As part of the depth domain model, properties such as the geometry of the drilling tool, material properties of the drilling tool (as well as the drill bit, the bottom hole assembly, or another tool or component used in the drilling operations), material properties of the surrounding formation, as well as other properties described herein may be utilized as model variables. Other models may be employed as part of the depth domain model or as inputs to the depth domain model. Such models may include one or more of a bottom hole assembly model, a bit/rock-interaction model, and a kinematic model. The bottom hole assembly model may compute at least one of the deflection, slope, bending moment, and shear along the bottom hole assembly. Bit/rock interaction model describes the bit motion of the drill bit 114 into the surrounding formation for a given set of generalized forces applied on the drill bit 114.

The outputs of the computed updating well path 340 may be provided to or involve a Model Predictive Control (MPC) controller 350 which may be used to generate steering commands 353 which are provided to the directional drilling device 355 (which may be the same as 150 in FIG. 1). Accordingly, the drilling device 355 may be steered to drill along the computed updated well path 340. Measurements 360 taken regarding the position, attitude, azimuth, as well as other parameters of the drilling device from downhole, drilling device or surface sensors and control units may be used to provide a current drill bit position 315. In this way, the computed updating well path system 300 may be provided as a feedback loop which is repeated for one or more targets and tolerance 310, which may be in continuous fashion, and which may be in real time or semi-real time.

Provided in the following is a mathematical description which may be implemented in the path updating process described herein. This description illustrates a simple two-dimensional version of the problem and represents only one of the embodiments of the current method.

The initial offset ($\Delta$) of the bottom-hole assembly or drill bit current position and its MD are computed from the well path of reference. The current relative position and attitude of the bottom-hole assembly or bit are given by:

$$\Delta_0=\Delta(MD_b)$$

$$\delta\Theta_0=\Theta_b-\Theta(MD)_b$$

where $\Delta_0$ denotes the initial offset of the borehole relative to the well path of reference, $MD_b$ measures the measured distance along the well path of reference corresponding to the current borehole position, $\delta\Theta_0$ is the relative bit inclination, $\Theta_b$ is the current borehole inclination, and $\Theta(MD_b)$ represents the inclination as given by the well path of reference at $MD_b$.

The relative offset of the target ($\Delta_r$) and its measured depth are computed based on the predetermined well path of reference. Maximum tolerances in position and attitude are included in the well path updating determination.

The form of the function for determining the perturbation (i.e., the offset) includes a fifth-order polynomial. While the example here employs a fifth-order polynomial, there is no particular limit to the order of the polynomial. Similarly, the shape of the function can take any mathematical form and can be defined completely by one single function or by interpolating functions of any kind between weighting points. If the function is defined by part, the distance between the interpolating stations/weighting points/targets can be constant or not. The perturbation may be determined by computing successive polynomials of any order. A succession of quadratic polynomial each related to a stand, for example, would provide a series of constant-curvature sections that could be directly related to slide/rotate ratios of a mud motor. Coefficients $\alpha_i$ of the polynomials are the state of the optimization routine:

$$\Delta(S)=\alpha_5S^5+\alpha_4S^4+\alpha_3S^3+\alpha_2S^2+\alpha_1S+\alpha_0, S\epsilon[MD_b, MD_t]$$

The boundary conditions for the polynomial are prescribed at the current borehole position (in terms of offset and relative attitude, and optionally curvature) and at the target. If there are tolerances at the target, the boundary conditions can still be expressed as a function of the position, attitude, and optionally curvature of the target, but the final offset, attitude, and/or curvature are new states of the optimization function.

$$\Delta(MD_b)=\Delta_0, \Delta'(MD_b)=\delta\Theta_0$$

$$\Delta(MD_t)=\Delta_t, \Delta'(MD_t)=\delta\Theta_t, \Delta''(MD_t)=0$$

The cost function J is expressed as a function of the state. The relative gains of each of the terms of the cost function are prescribed.

$$J=g_1\int k^2(\alpha_i)dS+g_2\int\Delta^2(\alpha_i)dS+\ldots.$$

The lower and upper bounds and constraints are prescribed for the states. For example, tolerances on the offset or relative attitude of the target are imposed. The constraints could be acting on local or global curvatures or tortuosity.

$$\Delta_{t,min}\leq\Delta_t\leq\Delta_{t,max}$$

With solution of the convex quadratic problem, the perturbation is then known along the well path as a function of the measured depth. The cost function may be minimized and may be illustrated by the following:

$$\underset{a_i}{\text{Min}}\ J$$

Given some constraints on maximum offset along the path, for example, it is possible that in some cases the problem cannot be solved. In that case, either an iterative process on the constraints is performed or a notification is sent to the user to indicate that the problem is over-constrained. This may also happen if the current borehole position is so far from the well path of reference that there exists no realistic way to reach the target.

The well path to follow is then updated from the computed perturbation. To do so, the determined offset may be projected back relative to the well plan in the Cartesian coordinate system of reference. The updated well path may further be used as input for an MPC formulation. The output may then be communicated to steering controls for adjusting the trajectory and path of the drilling device.

The aforementioned control loop and mathematical discussion is for illustration only. The perturbation is not required to be a polynomial, and furthermore may be divided over different sections of the well path of reference (e.g., to follow more accurately a tangent section for instance), and may include one or more way points along the way to enforce certain features of the desired borehole.

FIG. 4 is a block diagram of an exemplary computing device 400, which can include or be included in controller 152 (or components thereof). Device 400 is particularly configured to perform control techniques discussed herein and communicate signals that steer or direct the drilling tool along a curved well path.

As shown, device 400 includes hardware and software components such as network interfaces 410, a processor 420, sensors 460 and a memory 440 interconnected by a system bus 450. Network interface(s) 410 include mechanical, electrical, and signaling circuitry for communicating data over communication links, which may include wired or wireless communication links. Network interfaces 410 are configured to transmit and/or receive data using a variety of different communication protocols, as will be understood by those skilled in the art. For example, device 400 can use network interface 410 to communicate with one or more of the above-discussed directional drilling device 150 components and/or communicate with remote devices/systems such as computer system 137.

Processor 420 represents a digital signal processor (e.g., a microprocessor, a microcontroller, or a fixed-logic processor, etc.) configured to execute instructions or logic to perform tasks in a wellbore environment. The term processor as used herein, including processor 420, refers to one or more processors. Processor 420 may include a general purpose processor, special-purpose processor (where software instructions are incorporated into the processor), a state machine, application specific integrated circuit (ASIC), a programmable gate array (PGA) including a field PGA, an individual component, multiple components, an individual processor, a group (two or more) of separate and distinct processors, a distributed group of processors, and the like. Processor 420 typically operates in conjunction with shared or dedicated hardware, including but not limited to, hardware capable of executing software and hardware. For example, processor 420 may include elements or logic adapted to execute software programs and manipulate data structures 445, which may reside in memory 440.

Sensors 460 typically operate in conjunction with processor 420 to perform wellbore measurements, and can include special-purpose processors, detectors, transmitters, receivers, and the like. In this fashion, sensors 460 may include hardware/software for generating, transmitting, receiving, detecting, logging, and/or sampling magnetic fields, seismic activity, and/or acoustic waves.

Memory 440 comprises a plurality of storage locations that are addressable by processor 420 for storing software programs and data structures 445 associated with the embodiments described herein. Memory 440 may be a tangible (non-transitory) computer-readable medium, devices, and memories (e.g., disks/CDs/RAM/EEPROM/etc.). The components and/or elements described herein can be implemented as software on Memory 440 having program instructions executing on a computer, hardware, firmware, or a combination thereof. An operating system 442, portions of which are typically resident in memory 440 and executed by processor 420, functionally organizes the device by, inter alia, invoking operations in support of software processes and/or services executing on device 400. These software processes and/or services may comprise an illustrative path updating process 444, as described herein. Note that while control process 444 is shown in centralized memory 440, some embodiments provide for these processes/services to be operated in a distributed computing network.

It will be apparent to those skilled in the art that other processor and memory types, including various computer-readable media, may be used to store and execute program instructions pertaining to the techniques described herein. Also, while the description illustrates various processes, it is expressly contemplated that various processes may be embodied as modules configured to operate in accordance with the techniques herein (e.g., according to the functionality of a similar process). Further, while some processes or functions may be described separately, those skilled in the art will appreciate the processes and/or functions described herein may be performed as part of a single process. In addition, the disclosed processes and/or corresponding modules may be encoded in one or more tangible non-transitory computer readable storage media for execution, such as with fixed logic or programmable logic (e.g., software/computer instructions executed by a processor), and any processor may be a programmable processor, programmable digital logic such as field programmable gate arrays or an ASIC that comprises fixed digital logic. In general, any process logic may be embodied in processor 420 or computer readable medium encoded with instructions for execution by processor 420 that, when executed by the processor, are operable to cause the processor to perform the functions described herein.

The foregoing description has been directed to specific embodiments. It will be apparent, however, that other variations and modifications may be made to the described embodiments, with the attainment of some or all of their advantages. For instance, it is expressly contemplated that the components and/or elements described herein can be implemented as software being stored on a tangible (non-transitory) computer-readable medium, devices, and memories (e.g., disks/CDs/RAM/EEPROM/etc.) having program instructions executing on a computer, hardware, firmware, or a combination thereof. Further, methods describing the various functions and techniques described herein can be implemented using computer-executable instructions that are stored or otherwise available from computer readable media.

Such instructions can comprise, for example, instructions and data which cause or otherwise configure a general purpose computer, special purpose computer, or special purpose processing device to perform a certain function or group of functions. Portions of computer resources used can be accessible over a network. The computer executable instructions may be, for example, binaries, intermediate format instructions such as assembly language, firmware, or source code. Examples of computer-readable media that may be used to store instructions, information used, and/or information created during methods according to described examples include magnetic or optical disks, flash memory, USB devices provided with non-volatile memory, networked storage devices, and so on. In addition, devices implementing methods according to these disclosures can comprise hardware, firmware and/or software, and can take any of a variety of form factors. Typical examples of such form factors include laptops, smart phones, small form factor personal computers, personal digital assistants, and so on. Functionality described herein also can be embodied in peripherals or add-in cards. Such functionality can also be implemented on a circuit board among different chips or different processes executing in a single device, by way of further example. Instructions, media for conveying such instructions, computing resources for executing them, and other structures for supporting such computing resources are means for providing the functions described in these disclosures. Accordingly, this description is to be taken only by way of example and not to otherwise limit the scope of the embodiments herein. Therefore, it is the object of the appended claims to cover all such variations and modifications as come within the true spirit and scope of the embodiments herein.

Numerous examples are provided herein to enhance understanding of the present disclosure. A specific set of statements are provided as follows.

Statement 1: A method for an updated well path comprising: defining a well path of reference for a directional drilling device; determining a current actual borehole position of the directional drilling device; determining a perturbation to the well path of reference based on the current actual borehole position of the directional drilling device and a subterranean target; and obtaining the updated well path based on the perturbation.

Statement 2: The method of Statement 1 further comprising: steering the directional drilling device based on the updated well path.

Statement 3: The method of Statement 1 or 2 further comprising: determining the perturbation further based on a current attitude of one or more of a bottom hole assembly coupled with the directional drilling device, a drill bit coupled with the directional drilling device, or borehole.

Statement 4: The method of any one of the preceding Statements 1-3 wherein the well path of reference is an initial well plan.

Statement 5: The method of any one of the preceding Statements 1-4 wherein determining an updated well path comprises a cost function.

Statement 6: The method of Statement 5, wherein the cost function comprises a weighting function that measures relative weights of a plurality of components of the cost function.

Statement 7: The method of any one of the preceding Statements 5-6 wherein the cost function is based one or more of a curvilinear length of a borehole, offset of the borehole with respect to the well path of reference, inclination of the borehole with respect to the well path of reference, curvature of a current well path, and change of curvature of the current well path.

Statement 8: The method of any one of the preceding Statements 1-7, wherein determining the updated well path is further based on a constraint.

Statement 9: The method of Statement 8, wherein the constraint is selected from the group consisting of a maximum offset from the well path of reference, a maximum curvature along the well path of reference, a physical constraint of the directional drilling device, and combinations thereof.

Statement 10: The method of any one of the preceding Statements 1-9, wherein determining the updated well path comprises an attitude or position boundary parameters of the subterranean target.

Statement 11: The method of any one of the preceding Statements 1-10, wherein determining the perturbation is based on a plurality of subterranean targets.

Statement 12: The method of Statement 11, wherein one or more of the plurality of subterranean targets are a soft target, and one or more of the plurality of subterranean targets is a hard target.

Statement 13: The method of Statement 12 wherein determining the updated well path comprises an optimization based on one or more of a tortuosity limit, reduced arc length, and maximized rate of penetration.

Statement 14: The method of Statement 13, wherein determining the updated well path comprises no-go zones.

Statement 15: A system for updating a well path comprising: a directional drilling device disposed in a wellbore; and a processor, communicatively coupled with the directional drilling device, and a memory having stored therein a well path of reference and instructions which, when executed, causes the processor to: determine a current actual borehole position of a directional drilling device; determine a perturbation to a well plan based on the current actual borehole position of a directional drilling device and a target along the well path of reference; and obtaining an updated well path based on the perturbation.

Statement 16: The system of Statement 15 further comprising: instructing the directional drilling device based on the updated well path.

Statement 17: The system of Statement 15 or 16 wherein the memory has instructions which, when executed, causes the processor to further: determine the perturbation further based on a current attitude of one or more of a bottom hole assembly coupled with the directional drilling device, drill bit coupled with the directional drilling device, or borehole.

Statement 18: The system of any one of the preceding Statements 15-17 wherein the target is along the well plan.

Statement 19: The system of any one of the preceding Statements 15-18, wherein the updated well path is provided to a model predictive control (MPC).

Statement 20: A non-transitory computer-readable storage medium having a well path of reference and instructions stored thereon which, when executed by a processor, causes the processor to: determine a current actual borehole position of a directional drilling device; determine a perturbation to a well path of reference based on the current actual borehole position of a directional drilling device and a target along the well path of reference; and determine an updated well path based on the perturbation.

Statement 21: The non-transitory computer-readable storage medium of Statement 20, wherein the instructions further cause the processor to: instruct a directional drilling device based on the updated well path.

Statement 22: The non-transitory computer-readable storage medium of Statement 20 or 21, wherein the instructions further cause the processor to: determine the perturbation based on a current attitude of one or more of a bottom hole assembly coupled with the directional drilling device, drill bit coupled with the directional drilling device, or borehole.

Statement 23: The non-transitory computer-readable storage medium of any one of the preceding Statement 20-22, wherein the target is along the well path of reference.

What is claimed is:

1. A method for an updated well path comprising:

defining a well path of reference for a directional drilling device; determining a current position of the directional drilling device in a borehole;

determining a perturbation to the well path of reference based on the current position of the directional drilling device in the borehole and a subterranean target, wherein the perturbation is determined by:

identifying a distance between the current position of the directional drilling device and the subterranean target, projecting the distance onto a first plane and a second plane, identifying an interpolation function along a curvilinear length of the well path of reference; and performing a computation based on the projections of the distance onto the first plane and the second plane, the interpolation function for the perturbation along the curvilinear length of the well path of reference, and a cost function that includes a relative inclination of the borehole with respect to the well path of reference;

obtaining the updated well path based on the computation including the relative inclination of the borehole with respect to the well path of reference; and imparting an angular deviation of the directional drilling device based on the cost function and the updated well path, wherein the imparted angular deviation results in the directional drilling device drilling along the updated well path.

2. The method of claim 1 further comprising: identifying a tolerance to associate with the interpolation function, wherein the angular deviation of the directional drilling device is imparted to drill along the updated well path within the tolerance associated with the interpolation function.

3. The method of claim 1 further comprising:

determining the perturbation further based on a current attitude of one or more of a bottom hole assembly coupled with the directional drilling device, and a drill bit coupled with the directional drilling device, or borehole.

4. The method of claim 1 wherein the well path of reference is an initial well plan and the directional drilling device is controlled based on operation of an electronic controller that accesses data to determine the perturbation when the directional drilling device is automatically controlled by the electronic controller.

5. The method of claim 1, wherein the cost function includes a curvilinear length of the borehole.

6. The method of claim 5, wherein the cost function includes a weighting function that assigns respective weights to the inclination of the borehole and the curvilinear length of the borehole.

7. The method of claim 1, wherein:

the cost function includes an offset of the borehole with respect to the well path of reference, and the cost function assigns respective weights to the relative inclination of the borehole and the offset of the borehole with respect to the well path of reference.

8. The method of claim 1, wherein the cost function:

includes a curvature of a current well path and a change of curvature of the current well path, and the cost function assigns respective weights to the relative inclination of the borehole with respect to the well path of reference, the curvature of the current well path, and the change of curvature of the current well path.

9. The method of claim 8, wherein a constraint of the updated well path is selected from the group consisting of a maximum offset from the well path of reference, a maximum curvature along the well path of reference, a physical constraint of the directional drilling device, and combinations thereof.

10. The method of claim 1, wherein determining the updated well path comprises an attitude or position boundary parameters of the subterranean target.

11. The method of claim 1, wherein determining the perturbation is based on a plurality of subterranean targets.

12. The method of claim 11, wherein one or more of the plurality of subterranean targets are a soft target, and one or more of the plurality of subterranean targets is a hard target.

13. The method of claim 1, wherein determining the updated well path comprises an optimization based on one or more of a tortuosity limit, reduced arc length, and maximized rate of penetration.

14. A system for updating a well path comprising: a directional drilling device disposed in a borehole; and a processor, communicatively coupled with the directional drilling device, and a memory having stored therein a well path of reference and instructions which, when executed, causes the processor to:

determine a current position of a directional drilling device in the borehole; determine a perturbation to a well plan based on the current position of the directional drilling device in the borehole and a target along the well path of reference, wherein the perturbation is determined by: identifying a distance between the current position of the directional drilling device and the target, projecting the distance onto a first plane and a second plane, identifying an interpolation function along a curvilinear length of the well path of reference; and performing a computation based on the projections of the distance onto the first plane and the second plane, the interpolation function for the perturbation along the curvilinear length of the well path of reference, and a cost function that includes a relative inclination of the borehole with respect to the well path of reference;

obtaining the updated well path based on the computation including the relative inclination of the borehole with respect to the well path of reference; and imparting an angular deviation of the directional drilling device based on the cost function and the updated well path, wherein the imparted angular deviation results in the directional drilling device drilling along the updated well path.

15. The system of claim 14 further comprising:

identifying a tolerance to associate with the interpolation function, wherein the angular deviation of the directional drilling device is imparted to drill along the updated well path within the tolerance associated with the interpolation function.

16. The system of claim 14 wherein the memory has instructions which, when executed, causes the processor to further:

determine the perturbation further based on a current attitude of one or more of a bottom hole assembly coupled with the directional drilling device, and a drill bit coupled with the directional drilling device.

17. The system of claim 14 wherein the target is along the well plan.

18. The system of claim 14, wherein the updated well path is provided to a model predictive control (MPC).

19. A non-transitory computer-readable storage medium having a well path of reference and instructions stored thereon which, when executed by a processor, causes the processor to:

determine a current position of a directional drilling device in a borehole; determine a perturbation to a well path of reference in the borehole based on the current position of a directional drilling device in the borehole and a target along the well path of reference, wherein the perturbation is determined by:

identifying a distance between the current position of the directional drilling device and the target, projecting the distance onto a first plane and a second plane, identifying an interpolation function along a curvilinear length of the well path of reference; and performing a computation based on the projections of the distance onto the first plane and the second plane, the interpolation function for the perturbation along the curvilinear length of the well path of reference, and a cost function that includes a relative inclination of the borehole with respect to the well path of reference;

determine an updated well path based on the computation including the relative inclination of the borehole with respect to the well path of reference; and impart an angular deviation of the directional drilling device based on the cost function and the updated well path, wherein the imparted angular deviation results in the directional drilling device drilling along the updated well path.

20. The non-transitory computer-readable storage medium of claim 19, wherein the instructions further cause the processor to:

instruct a directional drilling device based on the updated well path.

21. The non-transitory computer-readable storage medium of claim 19, wherein the instructions further cause the processor to:

determine the perturbation based on a current attitude of one or more of a bottom hole assembly coupled with the directional drilling device, and a drill bit coupled with the directional drilling device.

22. The non-transitory computer-readable storage medium of claim 19, wherein the target is along the well path of reference.

* * * * *